United States Patent [19]

Matsuzaka et al.

[11] Patent Number: 4,610,958

[45] Date of Patent: Sep. 9, 1986

[54] PROCESS OF PREPARING A SILVER HALIDE EMULSION

[75] Inventors: Shoji Matsuzaka; Shinya Shimura, both of Hino, Japan

[73] Assignee: Konishiroku Photo Industry Co., Ltd., Tokyo, Japan

[21] Appl. No.: 678,333

[22] Filed: Dec. 5, 1984

[30] Foreign Application Priority Data

Dec. 7, 1983 [JP] Japan ..... 58-231944

[51] Int. Cl.[4] ..... G03C 1/02

[52] U.S. Cl. ..... 430/567; 430/569; 430/614; 430/615

[58] Field of Search ..... 430/614, 615, 567, 569

[56] References Cited

U.S. PATENT DOCUMENTS

| | | | |
|---|---|---|---|
| 2,444,605 | 7/1948 | Heimbach et al. | 430/615 |
| 2,444,606 | 7/1948 | Heimbach et al. | 430/615 |
| 2,449,225 | 9/1948 | Heimbach et al. | 430/615 |
| 2,835,581 | 5/1958 | Tinker et al. | 430/615 |
| 3,156,564 | 11/1964 | von Wartburg | 430/614 |
| 3,519,426 | 7/1970 | Halwig | 430/567 |
| 3,573,056 | 3/1971 | Baldock et al. | 430/615 |
| 3,689,270 | 9/1972 | Anderson et al. | 430/615 |
| 4,078,937 | 3/1978 | Tani et al. | 430/569 |

*Primary Examiner*—Mary F. Downey

*Attorney, Agent, or Firm*—Jordan B. Bierman

[57] ABSTRACT

A process of preparing a silver halide emulsion comprising mixing a water-soluble silver salt solution with a water-soluble halide solution in the presence of a protective colloid. Silver halide grains are formed which are octahedral or tetra decahedral silver iodobromide containing at least 4 mol % silver iodide. A tetrazaindene compound is added to the mixture before the completion of the addition of the silver salt solution.

8 Claims, 2 Drawing Figures

PROCESS OF PREPARING A SILVER HALIDE EMULSION

This application claims the priority of Japanese Application No. 231,944/1983, filed Dec. 7, 1983.

BACKGROUND OF THE INVENTION

1. Field of the Invention

This invention relates to a process for preparing monodispersed silver halide photographic emulsion and more particularly to a process for preparing a monodispersed silver iodobromide photographic emulsion.

2. Description of the Prior Art

Recently there have been increasing demands for silver halide photographic emulsions having better photographic characteristics such as high sensitivity, excellent graininess, high sharpness, low fog density and sufficiently high optical density.

Silver iodobromide emulsions containing iodide of from 0 to 10 mol% are well known as to high-sensitive emulsions capable of satisfying the above-mentioned demands. As for the processes of preparing these emulsions, there are conventionally known an ammonia method, a neutral method, and an acid method which control pH and pAg conditions; a single jet method and a double jet method which are called a method of mixing. Based on these well-known techniques, and in order to further attain high sensitivity, improved graininess, high sharpness and low fog, various technical means have been studied in detail and put to practical use. Silver iodobromide emulsions, which are the subject of the invention, have been so studied as to control not only a crystal habit, grain size distribution, but iodide density distribution in each of silver halide grains.

The most orthodox method to accomplish the above-described photographic characteristics such as high sensitivity, excellent graininess, high sharpness, low fog density, sufficiently high convering power is to improve quantum efficiency of a silver halide. For this purpose, the observation of solid state physics is positively introduced. The study of theoretically calculating this quantum efficiency and examining the influence of grain size distribution is described, for example, in "Interactions Between Light and Materials for Photographic Applications" on page 91 which is a preprint for 1980 Tokyo Symposium on photography advancement. According to this study, it is predicted that quantum efficiency will be improved with a monodispersed emulsion prepared by narrowing the range of grain size distribution. And further, it is considered to be reasonable to infer that a monodispersed emulsion may be advantageous for sensitizing a silver halide emulsion as well as for efficiently attaining high sensitivity with keeping fog lower in a chemical sensitization process which will be described in detail later.

For industrially preparing a monodispersed emulsion, as is described in Japanese Patent Publication Open to Public Inspection No. 48521/1979 (hereinafter referred to as Japanese Patent O.P.I. Publication), it is necessary to control the conditions of supply speeds of silver ions and halide ions to the reaction system which is calculated theoretically and the conditions of sufficient agitation, under severe control of the pAg and pH values thereof.

It is known that silver halide grains can variously be formed according to the controls of pAg during the growth of silver halide crystals. Silver halide emulsions prepared under these conditions have a shape of a cube, octahedron, or tetradecahedron respectively and consist of normal crystal grains having (100) face and (111) face in various proportion.

Measurement and control of pAg are monitored and controlled by means of devices already known in the art. Typical and useful control devices are described in U.S. Pat. No. 3,031,304 and photographische Korrespondenz, 1967 vol. 103, pp. 161–164.

However, it is rather difficult to practically prepare these monodispersed emulsions. As for a process of preparing monodispersed iodobromide emulsions, there are known those described in Japanese Patent O.P.I. Publication Nos. 49938/1983 and 157636/1982. Even such processes have a tendency that grain size distribution widens remarkably when silver iodide contents increase. That is, even with pure silver bromide crystals and under preparation conditions for good monodispersibility, when containing 2 to 40 mol% of silver iodide, the monodispersibility will be deteriorated. This tendency gets more remarkable with the increase of silver iodide content.

For example, according to a preparation process disclosed in Japanese Patent O.P.I. Publication No. 157636/1982, it is possible to prepare a monodispersed emulsion containing about 2 mol% of silver iodide, but when the content of silver iodide becomes 4 to 8 mol%, the monodispersibility deteriorates remarkably. This tendency is shown particularly in the grains in from tetradecahedral to octahedral shape rather than in the grains in the cubic shape.

High sensitive negative photographic materials of common type require to contain generally 2 to 10 mol% of silver iodide, and the so-called core-shell type emulsion which has a portion of higher silver iodide content within a grain needs for its core, even if it contains grains of 2 to 10 mol% silver iodide, monodispersed silver iodobromide grains containing 10 to 40 mol% silver iodide. Therefore, strongly desired is a technique to overcome the above-mentioned characteristics that monodispersibility deteriorates with the increase of silver iodide.

On the other hand, there are conventionally known preparation processes in which some additive is used in the process of forming silver halide crystals. For example, Berichte der Bunsengesellschaft, 1963 vol. 67, pp. 349–355, describes that the formation of silver chloride crystals may be stopped by adding a purine base such as adenine in the various stages of forming silver chloride crystals. U.S. Pat. No. 3,519,426 describes that fine grains of silver chloride may be formed by adding azaindene such as tetrazaindene, pentazaindene and adenine when silver chloride is precipitated and thus covering power is improved.

Further, Japanese Patent O.P.I. Publication No. 111937/1983 describes that in the formation of fine crystals of silver chlorobromide containing not less than 50 mol% of silver chloride, fine crystal of silver chloride in tablet shape may be obtained by using peptizers having a bond of aminoazaindene and thioether.

OBJECTS OF THE INVENTION

It is an object of the invention to provide technique that increases silver iodide content of silver iodobromide without deteriorating monodispersibility of a monodispersed emulsion. Another object of the invention is to provide a process of stably and industrially preparing a photographic emulsion having iodobromide crystal grains which are excellent in monodispersibility and particularly those grains in the forms of from tetradecahedron to octahedron.

A further object of the invention is to provide a process of stably preparing a monodispersed silver iodobromide emulsion which has low fog after chemical sensitization, high sensitivity and excellent graininess.

DETAILED DESCRIPTION OF THE INVENTION

Figure 1:
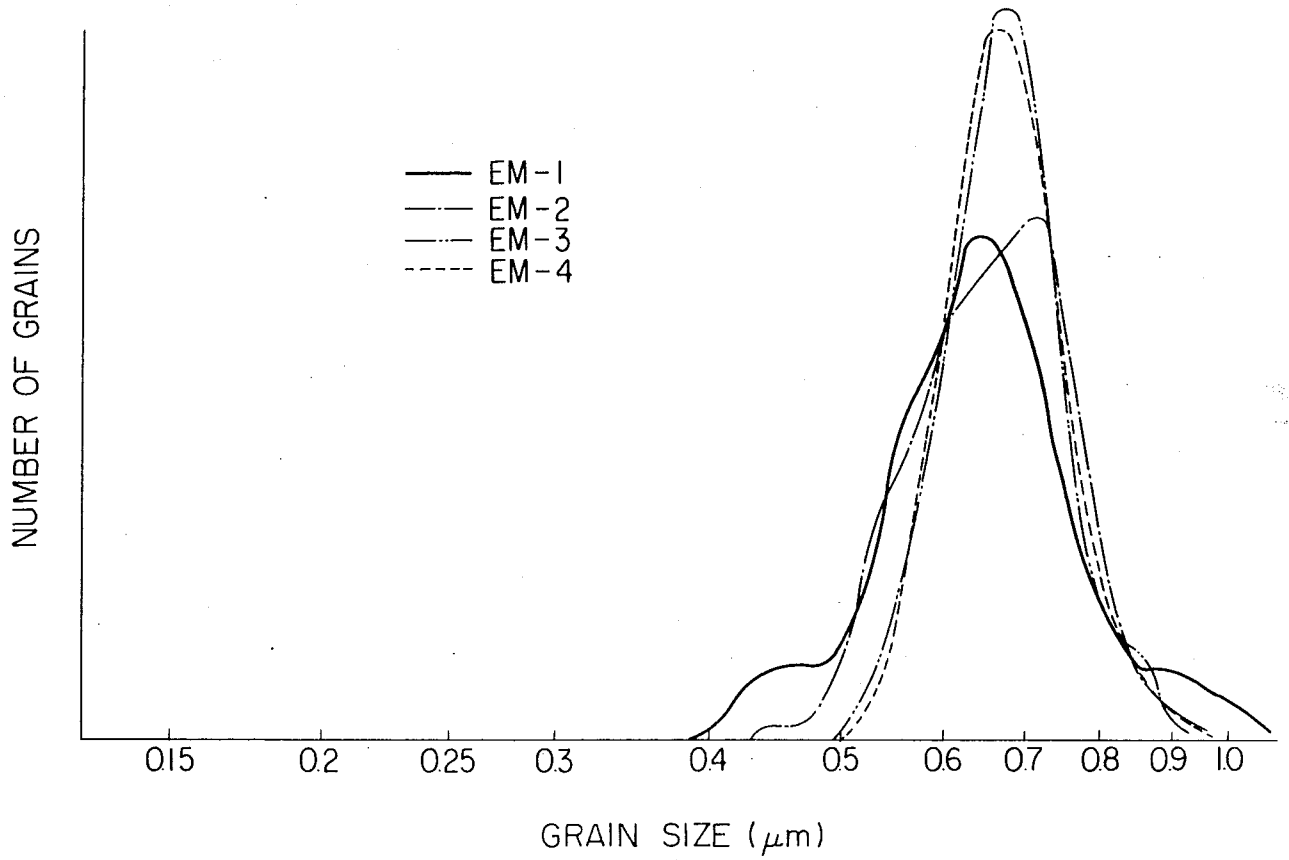

The inventors of the invention devoted themselves to study for the above objects and formed a process to stably prepare a monodispersed silver halide emulsion which is improved on fog, sensitivity and graininess compared with conventional ones.

The objects of the invention can be accomplished in a process of preparing a silver halide emulsion, which is described hereunder. The objects of the invention can be accomplished in a silver halide emulsion preparation process comprising a process of mixing a water-soluble silver salt solution with a water-soluble halide solution in the presence of a protective colloid, such silver halide emulsion preparation process characterized in that the silver halide emulsion is substantially made of silver iodobromide and a tetrazaindene compound is made to be present in the process of forming the silver halide grains.

To be concrete, in a process of preparing a silver halide emulsion which is substantially made of silver iodobromide containing silver iodide in the amount of from 0.5 to 40 mol% of the silver halide prepared by adding an aqueous silver salt solution and the aqueous solution of a water-soluble halide into the aqueous solution of a hydrophilic colloid, it was found the fact that silver iodobromide grains having a narrow grain size distribution can be obtained by making a tetrazaindene compound be present before finishing the addition of the water-soluble silver salt and in course of the addition of the aqueous solution of the water-soluble silver salt.

This invention is more effective on the preparation of silver iodobromide containing silver iodide in the range of from 0.5 to 40 mol% and particularly not less than 4 mol%.

In the case of using pure silver bromide, a silver halide emulsion may be prepared even in any conventional process.

The content of silver chloride is less than one mol% and preferably nil.

In the invention, the composition distributed in a silver iodobromide grain may be either even or uneven. In a silver halide emulsion prepared in the process relating to the invention, the surfaces of the grains thereof may also be covered with shells in a limited thickness such as those described in Japanese Patent O.P.I. Publication No. 154232/1982.

The invention is suitably applicable to the preparation of a monodispersed silver iodobromide comprising octahedral or tetradecahedral silver halide grains. In the invention, a monodispersed emulsion means an emulsion containing a silver halide whose grain size distribution is varied not wider than that of such a certain percentage as shown below to an average grain size. The grain size distribution of an emulsion comprising a group of light-sensitive silver halide grains of which the grain forms are even and the grain sizes are less varied (hereinafter called a monodispersed emulsion) is almost regular. Therefore, a standard deviation may readily be obtained by the following formula;

$$\text{Variation coefficient of grain sizes (\%)} = \frac{\text{Standard deviation}}{\text{Average grain size}} \times 100$$

when determining the scale of the distribution, the grain size variation coefficient of the silver halide grains relating to the invention is not more than 15% and preferably not more than 10%, so that they are monodispersive.

According to the preparation process of the invention, the silver halide emulsions can be applied not only to the case of growing from a seed grain but to the case of growing without using such seed grain. When using seed grains, it is preferred that the silver halide grains to serve as the seed grains are of a monodispersed emulsion, and the composition of such silver halide may be any one of silver chloride, silver bromide, silver iodide, silver iodobromide, silver chlorobromide and silver chloroiodobromide.

The compounds having the following Formula [I] are preferable for the tetrazaindene compounds to be used in the invention;

Formula [I]

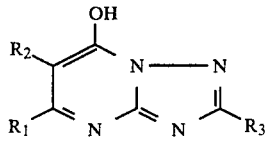

Wherein, $R_1$, $R_2$ and $R_3$ each is hydrogen, a substituted or unsubstituted alkyl group, a substituted or unsubstituted amino group, a halogen, a substituted or unsubstituted aryl group, or a —CONH—$R_4$ in which $R_4$ is hydrogen, a substituted or unsubstituted alkyl group, a substituted or unsubstituted amino group, a halogen, or a substituted or unsubstituted aryl group.

$R_1$ and $R_2$ may combine with each other to form a 5 or 6-membered ring such as a cyclo pentane ring and a cyclo hexane ring.

The following are the examples of tetrazaindene compounds relating to the invention;

Compound (1)

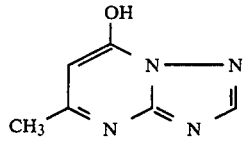

Compound (2)

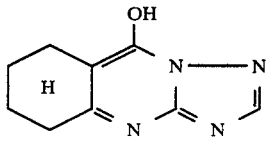

Compound (3)

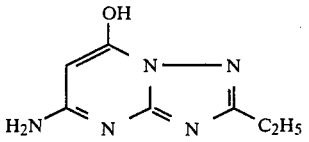

-continued

Compound (4)

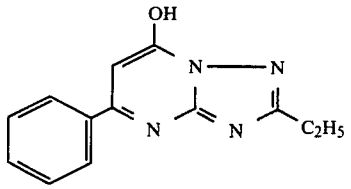

Compound (5)

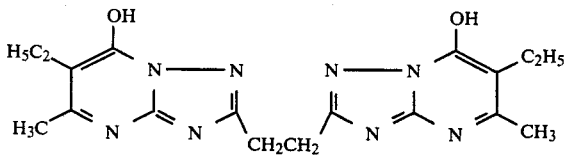

Compound (6)

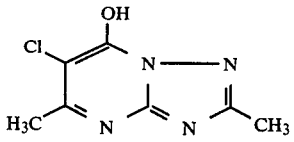

Compound (7)

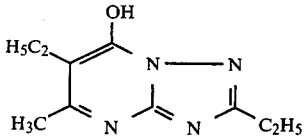

Compound (8)

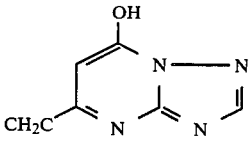

Compound (9)

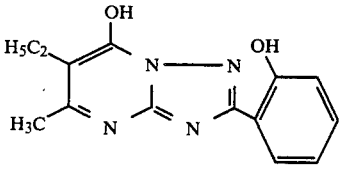

Compound (10)

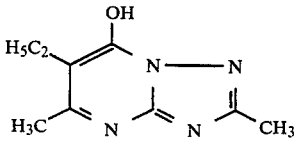

Compound (11)

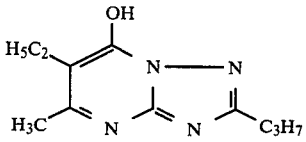

Compound (12)

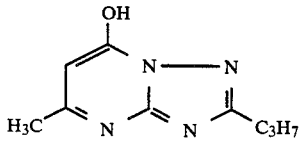

Compound (13)

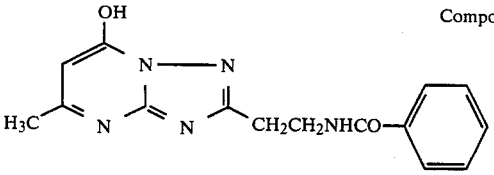

-continued

Compound (14)

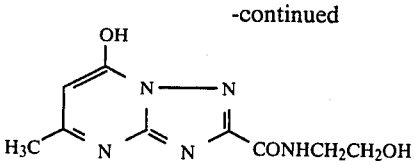

Compound (15)

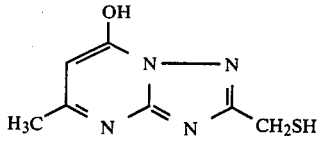

In the process of preparing a silver iodobromide emulsion of the invention, it is preferred to add an ammoniacal silver nitrate and an aqueous solution of a halide in the presence of ammonia in a double-jet process. It is also preferred that a pH value is kept in the range between 7 and 10 when the silver halide grains are being grown. It is further preferred that a pAg value is kept in the range between 8 and 10.5.

The amount of the tetrazaindene compound to be added for the invention depends more or less on the conditions of determining the grain sizes, pH values, etc., of silver iodobromide, and yet it is preferred to add such tetrazaindene compounds in the amount of from 50 mg to 1500 mg per mol of silver iodobromide.

The effects of monodispersion on the grains of the emulsions of the invention, and particularly on a silver halobromide emulsion containing a high-iodide are unexpectedly remarkable. As reported in the aforementioned Belichte der Bunsengesellschaft, vol. 67, pp. 349–355, 1963, the effect of an additive used when the grains of a silver halide are being formed may be displayed only on the silver halide grains containing many isometric system silver chloride of strong ionic bonding property, and the effect thereof lies only in obtaining fine grains by inhibiting the growth of the grains or in preparing a peculiar grain form. The effects thereof cannot be expected at all to include any of such a effect of silver iodobromide grains of this invention as to prevent the increase in the grain distribution of silver halobromide containing silver iodide of a strong hexagonal system property in a high content proportion, because the covalent bonding property of the silver iodobromide of the invention involves in.

The silver halide emulsion of the invention can be reduction-sensitized at any point of preparing process. Such a reduction sensitization may be made either in an emulsion agitation process under a low pAg condition, i.e., in a silver ripening process, or with such a suitable reducing agent as tin chloride, dimethylamine borane, hydrazine, thiourea dioxide and the like.

The light-sensitive silver halide emulsions of the invention may also be doped with a variety of metal salts or metal complexes when the silver halide is being precipitated or the grains thereof are being grown, or after the growth thereof is completed. For example, metal salts or metal complexes such as gold, platinum, palladium, rhodium, bismuth, cadmium, and copper, and the combination thereof may be used.

It is also allowed to remove excessive halide compounds produced or nitrates, salts such as an ammonia salt and compounds by-produced or unnecesitated, when an emulsion of the invention is being prepared. A noodle washing process, a dialysing process or a coagulation-precipitation process normally used in the case of an emulsion for general use may appropriately be used to remove the above-mentioned materials.

The emulsions of the invention may also be applied with a variety of chemical sensitization processes usually applied to the emulsions for general use. For example, chemical sensitizers uncluding an active gelatin; a noble metal sensitizer such as a water-soluble gold salt, a water-soluble platinum salt, a water-soluble palladium salt, a water-soluble rhodium salt, a water-soluble iridium salt or the like; a sulfur sensitizer; a selenium sensitizer; and the aforementioned reduction-sensitizers may be used independently or in combination. These silver halides may further be optically sensitized to a desired spectral range. The optical sensitization methods applied to the emulsions of the invention are not particularly limited but, an optical sensitizer including, for example, a cyanine or merocyanine dye such as zeromethine dye, monomethine dye, dimethine dye, trimethine dye may be used independently or in combination to sensitize optically, for example, for a hyper color sensitization.

These techniques are described also in U.S. Pat. Nos. 2,688,545, 2,912,329, 3,397,060, 3,615,635, and 3,628,964; British Pat. Nos. 1,195,302, 1,242,588 and 1,293,862; West German Patent (OLS) Nos. 2,030,326 and, 2,121,780; and Japanese Patent Examined Publication Nos. 4936/1968 and 14030/1969; and the like. The selection thereof can arbitrarily be determined according to a spectral range and a sensitivity to which a sensitization is to be made and to the purpose and use of a light-sensitive material.

The monodispersed silver halide emulsions of the invention may be used as the grain distribution thereof remains unchanged or by blending two or more monodispersed emulsions having the different average grain sizes from each other at an arbitrary point of time after the grains are formed so as to obtain a desired gradient. Further, it is allowed within the limit of not affecting the effects of the invention to contain any of the silver halide grains prepared in the other processes than those of the invention.

Hydrophilic colloids to be used in the emulsions relating to the invention may be used independently or in combination, including, for example, not only a gelatin treated with lime or an acid but also the gelatin derivatives such as those prepared by reacting a gelatin with an aromatic sulfonyl chloride, an acid chloride, an acid anhydride, an isocyanate, or a 1,4-diketone, as described in U.S. Pat. No. 2,614,928; those prepared by reacting a gelatin with a trimellitic acid anhydride as described in U.S. Pat. No. 3,118,766; those prepared by reacting a gelatin with an organic acid containing an active halogen as described in Japanese Patent Examined Publication No. 5514/1964; those prepared by reacting gelatin with an aromatic glycidyl ether described in Japanese Patent Examined Publication No. 26845/1967; those prepared by reacting gelatin with maleimide, maleamic acid, an unsaturated aliphatic diamide or the like described in U.S. Pat. No. 3,186,846; a sulfalkylated gelatin described in British Pat. No. 1,033,189; a polyoxyalkylene derivative of gelatin described in U.S. Pat. No. 3,312,553; a high molecular grafted matter of gelatin including, for example, acrylic acid, methacrylic acid, and an ester prepared with the mono- or poly-valent alcohol thereof, as well as a vinyl monomer of an amide, acryl or methacryl, etholyl, styrene or the like grafted, independently or in combination, to gelatin; a synthetic hydrophilic high molecular substance including, for example, a homopolymer comprising a monomer of vinyl alcohol, N-vinyl pyrolidone, hydroxyalkyl (metha) acrylate, (metha) acrylamide, N-substituted (metha) acrylamide or the like, or their copolymer, a copolymer of the above matter and (metha) acrylic acid ester, vinyl acetate, styrene or the like, a copolymer of one of the above matters and anhydrous maleic acid, maleamic acid or the like; a natural hydrophilic high molecular substance other than gelatin such as casein, agar, an alginic acid polysaccharide and the like. They may be used independently or in the mixture thereof.

The emulsions of the invention are allowed to contain variety of the additives being popularly used, in accordance with the purposes. These additives include, for example, a stabilizer or an antifoggant, such as an azaindene, a triazole, a tetrazole, an imidazolium salt, a tetrazolium salt, a polyhydroxy compound and the like; a hardener such as those of an aldehyde, an aziridine, an inoxazole, a vinyl sulfon, an acryloyl, a carbodiimide, a maleimide, a methane sulfonic acid ester, a triazine or the like; a development accelerator such as a benzyl alcohol or polyoxyethylene compound and the like; an image stabilizer such as those of a chroman, a coumaran, a bisphenol, or a phosphorous acid ester; a lubricant such as a wax, a glyceride of a higher fatty acid, a higher alcohol ester of a higher fatty acid; and the like. Besides, a coating aid as a surface active agent, a permeability improving agent for a processing liquid, a deforming agent, or a variety of anionic, cationic, nonionic or amphoteric base materials for controlling various physical properties of a light-sensitive material can be used. The effective antistatic agents include diacetyl cellulose, a styrene perfluoralkyl sodium maleate copolymer, an alkali salt of a reactant of a styrene-anhydrous maleic acid copolymer with p-aminobenzene sulfonic acid, and the like. The matting agents include, for example, polymethacrylic acid methyl, polystyrene, an alkali-soluble polymer and the like. In addition to the above, a colloidal silicon oxide can also be used. The latexes to be added for improving surface physical properties include, for example, a copolymer of an acrylic acid ester, a vinyl ester or the like and a monomer having an ethylene group other than the above. Gelatin plasticizers include glycerol and a glycol compound, and thickening agents include a styrene-sodium maleate copolymer, an alkylvinylether-maleic acid copolymer and the like.

The supports of the light-sensitive materials comprising the emulsions of the invention prepared as mentioned above include, for example, baryta paper, polyethylene coated paper, polypropylene synthetic paper, glass plate, cellulose acetate film, cellulose nitrate film, polyvinyl acetal film, polypropylene film, a polyester film such as polyethylene terephthalate film, polystyrene film and the like. These supports are suitably selected according to the respective purposes of silver halide photographic light-sensitive materials.

The supports are sublayered if occasion demands.

The emulsions of the invention may effectively be applied to a variety of light-sensitive materials such as those for general black-and-white photographic use, for radiographic use, for color photographic use, for infrared photographic use, for microphotographic use, for a silver dye bleach processing use, for reversal photographic use, for diffusion transfer processing use, and the like.

A wide lattitude can be obtained with the emulsions of the invention by mixing at least two kinds of monodispersed emulsions having the different average grain sizes or having the different sensitivity or by multiple-coating the emulsions.

The emulsions of the invention can suitably be used in a color light-sensitive material when the technique and materials used in the color light sensitive materials are applied thereto, for example, a combination of cyan, magenta and yellow couplers is contained in the emulsions of the invention of which the red-, green- and blue-sensitivity are adjusted.

As for yellow couplers, well-known open-chain ketomethylene couplers can be used. Among them, benzoylacetanilide and pivaloylacetanilide compounds are useful.

As for magenta couplers, a pyrazolone compound, an indazolone compound and a cyanoacetyl compound are used.

As for cyan couplers, a phenol compound, a naphthol compound and the like are used.

The light-sensitive materials prepared with the emulsions of the invention can be developed after exposure in a popularly used and well-known process.

Black-and-white developing solution is an alkaline solution containing such a developing agent as a hydroxybenzene, an aminophenol, an aminobenzene or the like, and is capable of containing, besides the above, such an alkali metal salt as a sulfite, a carbonate, a hydrogen-sulfite, a bromide, an iodide and the like. When the light-sensitive material is a color light-sensitive material, it can be color-developed in a usually used color developing process. In a reversal process, a light-sensitive material is developed in a black-and-white negative developer at first, and is then exposed to white light or is processed in a bath containing a fogging agent, and is further color-develoed in an alkaline developer containing a color developing agent. The processing shall not particularly be limited but can be applied with any kind of processes. The typical processes applicable thereto include a process in which, after a color development, a bleach-fix process is carried out and a washing and a stabilizing processes are then carried out if necessary, and another process in which, after a color development, a bleaching process and a fixing process are carried out separately and a washing and a stabilizing processes are carried out if necessary.

EXAMPLE

The invention will more detailedly be described with reference to the following Examples and it is to be understood that the invention shall not be limited thereto.

EXAMPLE-1

A silver iodobromide emulsion containing a 10 mol% silver iodide was prepared by making use of five kinds of the solutions listed below. The seed emulsion thereof was a cubic silver iodobromide emulsion containing 2 mol% silver iodide, and the emulsion grains each are 0.295 μm in average edge length and 10% in the coefficient of variation.

| | |
|---|---|
| (Solution A-1) | |
| Osein gelatin | 113 g |
| Distilled water | 8000 ml |
| 10% aqueous ethanol solution of polyisopropylene-polyethylene-oxydisuccinic acid ester sodium salt | 1.13 ml |
| 28% aqueous ammonia | 83 ml |
| Seed emulsion | 0.075 mol |
| Add distilled water to make | 11,320 ml |
| (Solution B-1) | |
| Osein gelatin | 40 g |
| KBr | 104.7 g |
| KI | 16.6 g |
| Add distilled water to make | 2,000 ml |
| (Solution D-1) | |
| $AgNO_3$ | 169.9 g |
| Distilled water | 260 ml |
| 28% aqueous ammonia | 139 ml |
| Add distilled water to make | 2,000 ml |
| (Solution E-1) | |
| 50% aqueous KBr solution value. | In an amount required for adjusting pAg |
| (Solution F-1) | |
| 56% aqueous acetic acid solution | In an amount required for adjusting pH value. |
| (Solution G-1) | |
| KBr | 17 g |
| Distilled water | 60 ml |

By making use of a mixing stirrer and at the temperature of 50° C., Solution A-1 was added with Solutions D-1 and B-1 in a double-jet method, taking 79.5 minutes that is a minimum time of not producing small grains in the process. The values of pAg and pH and the adding rate of Solution D-1 in course of double-jetting were controlled as shown in Table-1. The values of pAg and pH were controlled by a flow controllable roller-tube pump, with varying the flow of Solutions E-1, F-1 and B-1, respectively.

Two minutes after Solution D-1 was added, Solution G-1 was added. Further, two minutes after then, the pH value was adjusted to 6.0 with Solution F-1.

TABLE 1

(Temperature of Emulsion: 50° C.)

| Time (min.) | pAg | pH | Adding Rate of Solution D-1 (ml/min.) |
|---|---|---|---|
| 0.0 | 8.31 | 9.00 | 8.20 |
| 6.72 | 8.33 | 9.00 | 10.38 |
| 13.44 | 8.36 | 9.00 | 12.83 |
| 20.16 | 8.40 | 9.00 | 15.55 |
| 26.89 | 8.44 | 9.00 | 18.53 |
| 33.76 | 8.50 | 9.00 | 21.79 |
| 40.33 | 8.55 | 9.00 | 25.11 |
| 47.06 | 8.62 | 9.00 | 28.61 |
| 53.78 | 8.69 | 9.00 | 32.17 |
| 58.05 | 8.75 | 9.00 | 34.61 |
| 67.23 | 8.87 | 9.00 | 38.82 |
| 69.00 | 8.89 | 9.00 | 39.38 |
| 79.84 | 9.04 | 9.00 | 37.97 |

The mixture thus prepared was desalted and washed in an ordinary process and was dispersed in an aqueous solution containing 14.1 g of osein gelatin. After then, the aggregate amount thereof was adjusted to 425 ml with distilled water. Thus prepared emulsion is hereafter called EM-1. Silver halide grains in EM-1 were observed through an electron microscope. The results thereof were that the coefficient of variation in the grain size distribution was 18.2% and the grains comprise twinned crystal grains in the ratio of 10% and cubic grains of 0.70 μm in edge length of grain size in terms of a cube, (assuming that such cube grains each are in the same volume.)

EXAMPLE-2

Four kinds of emulsions, EM-2 to EM-5, were prepared in the same manner as in Example-1, except that Solutions A-1 and B-1 used in Example-1 were added with Compound-1 having the following Formula in the amount shown in Table-2;

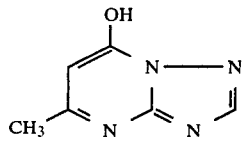

Compound-1

TABLE 2

| EM | Amount of Compound-1 added, in mg. (solution A-1) | (Solution B-1) | Total |
|---|---|---|---|
| EM-1 (Example-1) | 0 | 0 | 0 |
| EM-2 | 10.5 | 131 | 141.5 |
| EM-3 | 21 | 262 | 283 |
| EM-4 | 63 | 786 | 849 |
| EM-5 | 210 | 2620 | 2830 |

Figure 2:
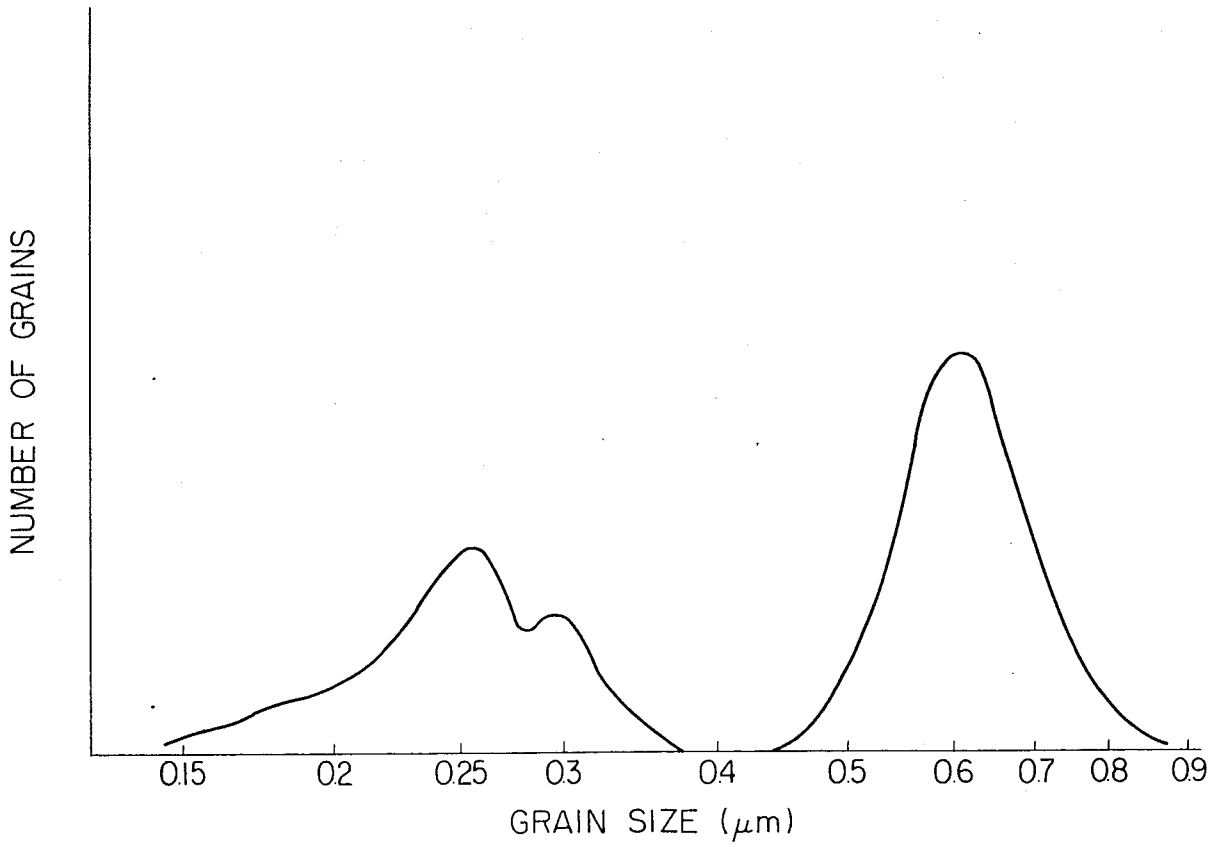

Table-3 below shows the results of an electron-microscopic observation on EM-1 to EM-5, and FIG. 1 shows the respective grain size distribution curves of silver halide emulsions, EM-1, EM-2, EM-3 and EM-4, prepared in the examples given; and FIG. 2 shows the grain size distribution curve of the silver halide emulsion, EM-5. As is obvious from the results shown in Table-3, it is understood that the cubic configuration of silver halide grains are changed by adding a compound thereto into from tetradecahedron to octahedron, and the grain distribution thereof becomes narrow, so that a monodispersed emulsion can be obtained. In EM-5, fine grains, besides the seed grains, were found and the grain distribution was widened. If an amount of a tetrazaindene compound was excessively added, it was found not to be preferred, because the inhibition of a crystal growth took effect.

TABLE 3

| EM | Amount of Compound-1 added (mg/mol AgX) | Average Grain Size (μm) | Variation Coefficient (%) | Grain Form | Remark |
|---|---|---|---|---|---|
| EM-1 | 0 | 0.70 | 18.2 | Cube | |
| EM-2 | 141.5 | 0.70 | 11.9 | Tetra-decahedron | |
| EM-3 | 283 | 0.70 | 8.9 | Tetra-decahedron | |
| EM-4 | 849 | 0.70 | 7.8 | Octahedron | |
| EM-5 | 2830 | 0.56 | 39.9 | Octahedron | Fine grains produced. |

EXAMPLE-3

By making use of five kinds of the following solutions, 12 kinds in total of the silver iodide emulsions and the silver iodobromide emulsions shown in Table-4 were prepared, respectively. The seed emulsion was an octahedral silver iodobromide emulsion containing 2 mol% silver iodide and the average edge length of the emulsion grains thereof was 0.27 μm and the degree of the grain size distribution (the variation coefficient) was 10%.

| | |
|---|---|
| (Solution A-2) | |
| Osein gelatin | 11.32 g |
| Distilled water | 1,081.3 ml |
| 10% aqueous ethanol solution of polyisopropylene-polyethyleneoxy-disuccinic acid ester sodium salt | 2.83 ml |
| 56% acetic acid | 10.9 ml |
| 28% aqueous ammonia | 16.6 ml |
| Seed emulsion | 0.0384 mol |
| Compound-1 | Amount added shown in Table 4 |
| (Solution B-2) | |
| Osein gelatin | 40 g |
| KBr | Amount added shown in Table 4 |
| KI | Amount added shown in Table 4 |
| Compound-1 | Amount added shown in Table 4 |
| Add distilled water to make | 285.7 ml |
| (Solution D-2) | |
| $AgNO_3$ | 169.9 g |
| Distilled water | 380 ml |
| 28% aqueous ammonia | 139 ml |
| Add distilled water to make | 285.7 ml |
| (Solution E-2) | |
| 50% aqueous KBr solution | Amount required for adjusting pAg value. |
| (Solution F-2) | |
| 56% aqueous acetic acid solution | Amount required for adjusting pH value. |

By making use of a mixing stirrer and at the temperature of 40° C., Solution A-2 was added with Solutions D-2 and B-2 in a double-jet method, taking 76.9 minutes that is a minimum time of not producing small grains in the process. The values of pAg and pH and the adding rate of Solution D-2 in course of double-jetting were controlled as shown in Table-5. The values of pAg and pH were controlled by a flow controllable roller-tube pump, with varying the flow of Solutions E-2, F-2 and B-2, respectively.

Two minutes after Solution D-2 was added, the pH value was adjusted to 6.0 with Solution F-2.

Next, the mixture thus prepared was desalted and washed in an ordinary process and was dispersed in an aqueous solution containing 14.1 g of osein gelatin. After then, the aggregate amount thereof was adjusted to 425 ml with distilled water. Thus prepared emulsions are hereafter called Em-6 and EM-7, respectively.

TABLE 4

| EM | B-2 KBr | KI (AgI content) | Amount of Compound-1 added (Solution A-2) | (Solution B-2) | Total |
|---|---|---|---|---|---|
| EM-6 | 116.6 g | 0 g (0 mol %) | 0 mg | 0 mg | 0 mg |
| EM-7 | 116.6 g | 0 g (0 mol %) | 38.1 mg | 304.5 mg | 342.6 mg |
| EM-8 | 114.2 g | 3.32 g (2 mol %) | 0 mg | 0 mg | 0 mg |
| EM-9 | 114.2 g | 3.32 g (2 mol %) | 38.1 mg | 304.5 mg | 342.6 mg |
| EM-10 | 111.8 g | 6.64 g (4 mol %) | 0 mg | 0 mg | 0 mg |
| EM-11 | 111.8 g | 6.64 g (4 mol %) | 38.1 mg | 304.5 mg | 342.6 mg |
| EM-12 | 107.1 g | 13.28 g (8 mol %) | 0 mg | 0 mg | 0 mg |
| EM-13 | 107.1 g | 13.28 g (8 mol %) | 38.1 mg | 304.5 mg | 342.6 mg |
| EM-14 | 104.7 g | 16.60 g (10 mol %) | 0 mg | 0 mg | 0 mg |
| EM-15 | 104.7 g | 16.60 g | 38.1 mg | 304.5 mg | 342.6 mg |

TABLE 4-continued

| EM | B-2 KBr | B-2 KI (AgI content) | Amount of Compound-1 added (Solution A-2) | Amount of Compound-1 added (Solution B-2) | Amount of Compound-1 added Total |
|---|---|---|---|---|---|
| | | (10 mol %) | | | |
| EM-14 | 98.8 g | 24.90 g (15 mol %) | 0 mg | 0 mg | 0 mg |
| EM-17 | 98.8 g | 24.90 g (15 mol %) | 38.1 mg | 304.5 mg | 342.6 mg |

TABLE 5

(Temperature of Emulsion: 40° C.)

| Time (min.) | pAg | pH | Adding Rate of Solution D-2 (ml/min.) |
|---|---|---|---|
| 0.0 | 9.00 | 9.00 | 0.486 |
| 13.02 | 9.03 | 8.95 | 1.181 |
| 19.53 | 9.07 | 8.91 | 1.731 |
| 26.05 | 9.11 | 8.85 | 2.460 |
| 32.56 | 9.17 | 8.78 | 3.338 |
| 39.07 | 9.24 | 8.69 | 4.243 |
| 45.59 | 9.33 | 8.57 | 4.970 |
| 52.10 | 9.43 | 8.45 | 5.345 |
| 58.61 | 9.54 | 8.32 | 5.345 |
| 65.13 | 9.63 | 8.20 | 5.082 |
| 71.64 | 9.73 | 8.08 | 4.692 |
| 76.90 | 9.79 | 8.00 | 4.016 |

The EM-6 and EM-7 were observed through an electron microscope. The results thereof are shown in Table-6, below. As is obvious from the results, it is found that the monodispersibility tends to be deteriorated as a silver iodide content goes on increasing, and the improvement thereof may be made by adding compound-1.

TABLE 6

| EM | AgI Content (mol %) | Amount of Compound-1 added (mg/mol AgX) | Average Grain Size (μm) | Variation Coefficient (%) | Crystal Form, Remark |
|---|---|---|---|---|---|
| EM-6 | 0 | 0 | 0.80 | 9.8 | Tetradecahedron |
| EM-7 | 0 | 342.6 | 0.80 | 8.9 | Octahedron |
| EM-8 | 2 | 0 | 0.81 | 10.1 | Tetradecahedron |
| EM-9 (Invention) | 2 | 342.6 | 0.80 | 9.3 | Octahedron |
| EM-10 | 4 | 0 | 0.84 | 16.3 | Cube - Octahedron mixture |
| EM-11 (Invention) | 4 | 342.6 | 0.80 | 10.3 | Octahedron |
| EM-12 | 8 | 0 | 0.85 | 29.5 | Cube - Octahedron mixture Coarse/small grains produced. |
| EM-13 (Invention) | 8 | 342.6 | 0.81 | 11.3 | Octahedron |
| EM-14 | 10 | 0 | 0.55 | 33.1 | Cube - Octahedron mixture Coarse/small grains produced. |
| EM-15 (Invention) | 10 | 342.6 | 0.80 | 11.8 | Octahedron |
| EM-16 | 15 | 0 | 0.61 | 35.1 | Cube - Octahedron mixture Coarse/small grains produced. |
| EM-17 (Invention) | 15 | 342.6 | 0.80 | 12.3 | Octahedron |

EFFECTS OF THE INVENTION

According to the invention, it is achieved to introduce silver iodides respectively having heterocrystal systems and heterocohesive strength into a silver halobromide having a group of monodispersive grains mainly composed of an isometric system type ionic bond, and also to make uniform the physical properties and the chemical characteristics of every grain.

What is claimed is:

1. A process of preparing a monodispersed silver halide emulsion comprising mixing a water-soluble silver salt solution with a water-soluble halide solution in the presence of a protective colloid and thereby forming silver hallide grains, wherein said silver halide grains consist essentially of octahedral or tetradecahedral silver iodobromide containing at least 4 mole % to 40 mole percent of silver iodide and a tetrazaindene compound is added thereto before finishing the addition of said water-soluble silver salt solution.

2. A process of preparing a silver halide emulsion as claimed in claim 1, wherein the process of forming said silver halide grains comprises a step of forming monodisperse seed grains and a successive step of growing silver halide grains out of said seed grains.

3. A process of preparing a silver halide emulsion as claimed in claim 1, wherein the pH value in the step of forming said silver halide grains is from 7 to 10.

4. A process of preparing a silver halide emulsion as claimed in claim 3, wherein the pAg value is from 8 to 10.5.

5. A process of preparing a silver halide emulsion as claimed in claim 1, wherein said tetrazaindene compound has the following Formula;

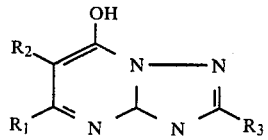

Formula [I]

wherein, $R_1$, $R_2$ and $R_3$ each is hydrogen, a halogen, a substituted or unsubstituted alkyl group, an amino group, an aryl group, or a —CONH—$R_4$ in which $R_4$ is hydrogen, a halogen, a substituted or unsubstituted alkyl group, amino group, or an aryl group.

6. A process of preparing a silver halide emulsion as claimed in claim 1, wherein the quantity of said tetrazaindene added is from 50 to 1500 mg per mole of a silver halide.

7. A process of preparing a silver halide emulsion as claimed in claim 1, wherein said silver halide emulsion is a monodispersed silver halide emulsion.

8. A process of preparing a silver halide emulsion as claimed in claim 1, wherein said tetrazaindene compound is contained in the amount of from 50 mg to 1500 mg per mol of silver iodobromide.

* * * * *